United States Patent [19]

Bernardini

[11] Patent Number: 5,071,366

[45] Date of Patent: Dec. 10, 1991

[54] CIRCULAR IDC CONNECTOR

[75] Inventor: Allen J. Bernardini, Southbury, Conn.

[73] Assignee: Litton Systems, Inc., Watertown, Conn.

[21] Appl. No.: 589,538

[22] Filed: Sep. 28, 1990

[51] Int. Cl.[5] ..... H01R 4/24
[52] U.S. Cl. ..... 439/417
[58] Field of Search ..... 439/389–425

[56] References Cited

U.S. PATENT DOCUMENTS 3,980,380 9/1976 Cieniawa et al. ..... 439/404

*Primary Examiner*—Joseph H. McGlynn
*Attorney, Agent, or Firm*—Brian L. Ribando

[57] ABSTRACT

A circular connector comprises an array of IDC contacts and an insulated disk which fits over the contact array. A threaded backshell advances the insulating disk onto the contacts as it is screwed onto the connector body and the insulating disk forces an array of wire ends into the slots of the IDC contacts.

13 Claims, 3 Drawing Sheets

Fig_2
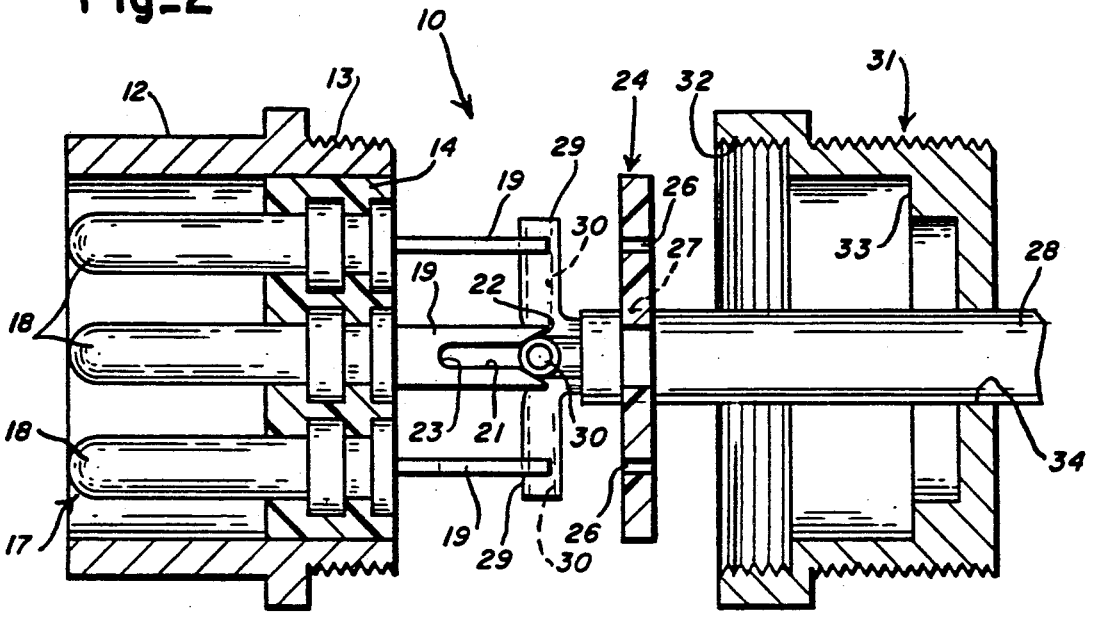
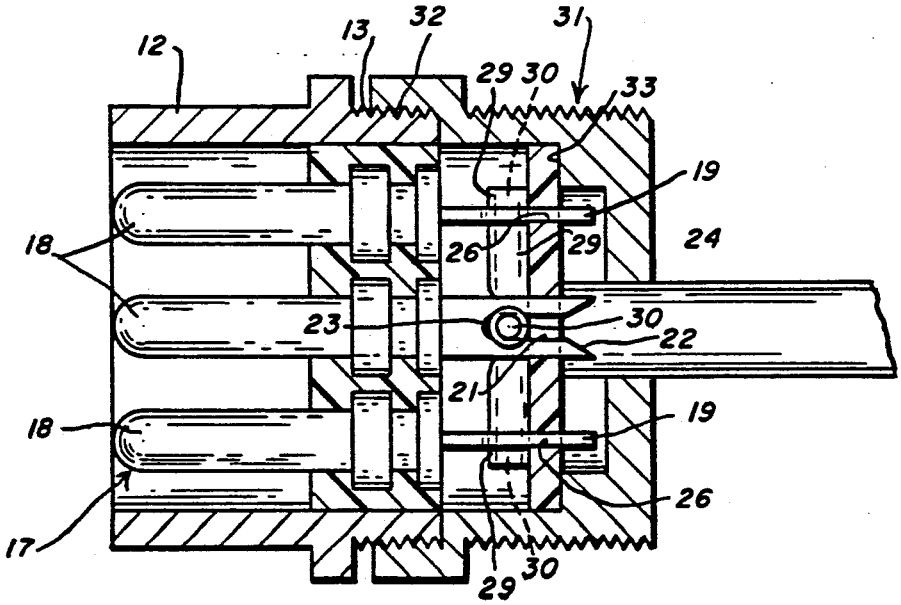
Fig_3

CIRCULAR IDC CONNECTOR

BACKGROUND OF THE INVENTION

The invention relates to a circular connector having a plurality of IDC contacts which terminate a plurality of wires without the use of auxiliary tools.

Circular connectors and IDC contacts are both well known in the art. Circular connectors are used to removably couple a plurality of signal or power leads from a cable or a piece of equipment to another cable or piece of equipment. IDC contacts make a gas-tight connection to a wire without the use of solder by means of an elongated slot in a contact end which slices through the insulation of a wire and makes a secure mechanical and electrical connection to the metal conductor located therein. According to the prior art, a separate tool such as a special purpose pliers-type device or a press is often used to force the individual wires into the IDC slots in the contacts. Thereafter, a separate strain relief member may be used to prevent withdrawal of the wires from the IDC slots caused by a tension on the wire. While such a procedure is acceptable for factory termination of wires to the IDC contacts, it is often necessary to install or repair such connectors in the field where specialty tools are not available. Accordingly, there is a need in the art for a circular connector using IDC contacts which may be terminated without the use of specialty tools.

SUMMARY AND OBJECTS OF THE INVENTION

According to the invention, a circular connector comprises a plurality of contacts which are mounted in an array. An insulated disk fits over the IDC end of each of the contacts and is used to force the individual wires into engagement with the IDC slots. A threaded backshell includes a shoulder which bears on the disk so that tightening the backshell onto the connector body causes the disk to force the wires into the IDC slots. Once assembled, the disk creates a strain relief for the wires which have been terminated to the contacts.

It is accordingly an object of the invention to provide a circular connector using IDC contacts which may be terminated without the use of specialty tools.

It is another object of the invention to provide a circular contact comprising an array of IDC contacts and an apertured disk which mates with the contacts and is used to seat the wires into the IDC slots.

These and other objects of the invention will become apparent from the following detailed description in which reference numerals used throughout the description correspond to the reference numerals used on the drawing figures.

BRIEF DESCRIPTION OF THE DRAWINGS

FIG. 2 is a side view partially in section of the circular connector of FIG. 1.

FIG. 3 is a side view partially in section of the connector of FIGS. 1 and 2 in a fully assembled state.

DESCRIPTION OF THE PREFERRED EMBODIMENT

Figure 1:
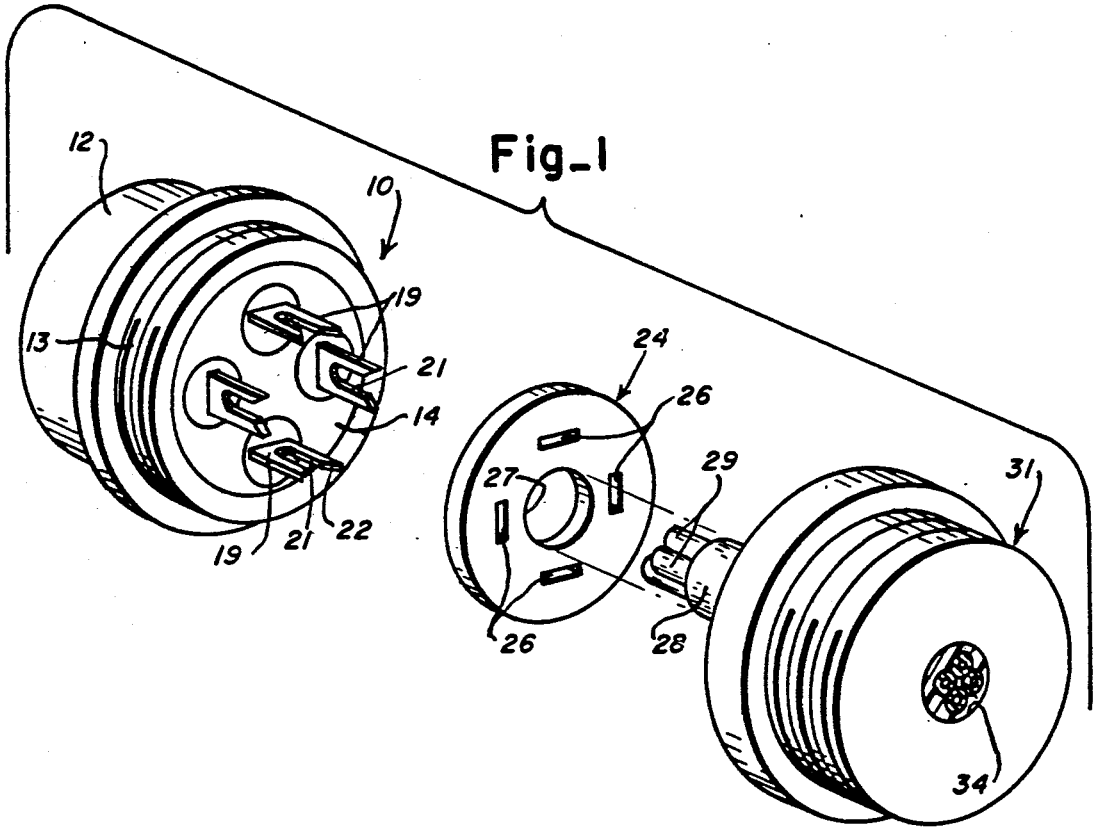
FIG. 1 is an exploded perspective view of a circular connector according to the invention.

Turning now to FIG. 1, there is shown a circular connector generally designated by the reference numeral 10. The connector comprises a connector body 12 having external threads 13 formed on one end thereof. The body houses an insulator 14 in which an array of electrical contacts 17 is mounted. The contacts 17 each comprise a front pin end 18 and a rear IDC end 19. Each IDC end 19 includes a slot 21 having an open flared end 22 and a closed end 23.

An apertured disk 24 of insulating material such as plastic includes a plurality of rectangular slots 26 which are arranged in a pattern corresponding to the pattern of the insulation displacement contact ends 19. The insulating disk 24 additionally includes a central aperture 27 which allows passage of an electrical cable 28 comprising a plurality of individual wires 29. Each wire 29 includes a central conductor 30.

The circular connector also comprises a removable backshell 31 having internal threads 32 and a circular shoulder 33 best seen in FIG. 2. The backshell includes a central aperture 34 for passage of the electrical cable 28.

FIG. 3 shows the circular connector of FIGS. 1 and 2 in the fully assembled state. The conductor 30 in each of the wires 29 has been forced to the closed end 23 of the slot 21 by the insulating disk 24.

In use, the cable 28 is passed through the apertures 34 and 27 in the backshell 27 and the insulating disk 24, respectively, and the individual wires 29 are splayed from the cable end in order to be closely adjacent the flared end 22 of the insulation displacement contacts 19. Screwing the backshell 31 onto the connector body 12 causes the circular shoulder 33 of the backshell to engage the insulating disk 24 and to advance the disk over the IDC contacts 19. As this occurs, the individual wires 29 are forced into the flared ends 22 of the IDC contacts and along the length of the slots 21 until the conductor 30 in each wire is forced against the closed end 23 of the slot. In this position, a secure electrical and mechanical connection is made between the IDC contact and the conductor 30; and the insulating disk acts as a strain relief to prevent displacement of the wires 29 from the slots 21 in response to tension on the cable 28. Thus, it is possible to terminate the individual wires with the insulation displacement contacts without the use of specialty tools.

Figure 4:
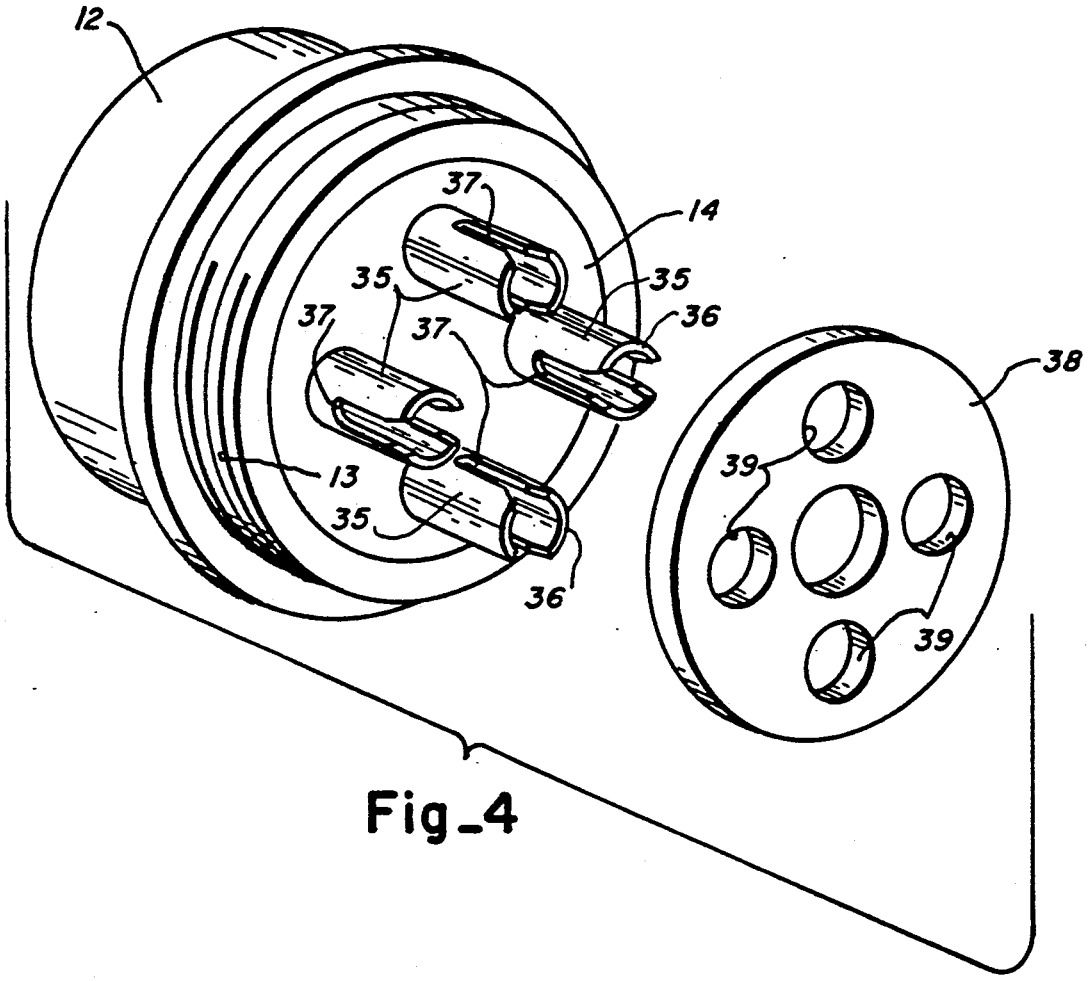
FIG. 4 is an exploded perspective view of an alternate embodiment of the invention.

FIG. 4 shows an alternate embodiment of the invention in which each contact 35 has a tubular end 36 with two slots 37 on either side of the tubular end. The two slots 37 provide a redundant connection with wires (not shown) which are terminated to the contact. A disk 38 of insulating material includes a plurality of circular apertures 39 which are arranged in a pattern to mate with the tubular ends 36 of the contacts 35.

Although an array of four contacts have been shown in the circular connector, it will be appreciated by those skilled in the art that other contact arrays may also be used. Also, although pin ends have been shown on the front of each contact 17, socket ends may also be used.

Having thus described the invention, various modifications and alterations will be apparent to those skilled in the art, which modifications and alterations are intended to be within the scope of the invention as defined by the appended claims.

What is claimed is:

1. A circular connector for terminating a plurality of wires to an array of contacts comprising:

a connector body comprising a cylindrical housing having a central axis and a plug-shaped insulator mounted in the housing;

an array of contacts mounted in the plug-shaped insulator, each contact having a front end and a wire terminating end;

an insulation displacement slot formed on the wire terminating end of each contact wherein each slot is parallel to said central axis;

an insulating disk which is orthogonal to said central axis having an array of apertures which mates with the array of contacts; and a backshell which mates to the connector body, whereby the backshell advances the insulating disk onto the contacts in a direction which is parallel to said central axis and forces the wires into the slots without the use of auxiliary tools.

2. The connector of claim 1 further comprising:

a threaded coupling between the housing and the backshell, whereby screwing the backshell onto the housing provides a mechanical advantage to advance the insulating disk onto the contacts and force the plurality of wires into the insulation displacement slots.

3. The connector of claim 2 further comprising:

a shoulder formed on the backshell, whereby the insulating disk is advanced onto the contacts by the shoulder.

4. The connector of claim 2 further comprising:

an aperture in the center of the insulating disk for the passage of the plurality of wires.

5. The connector of claim 4 wherein the wire terminating end of each contact is blade shaped and the apertures in the insulating disk which mate with the contacts are rectangular.

6. The connector of claim 4 wherein the wire terminating end of each contact is tubular and the apertures in the insulating disk which mate with the contacts are circular.

7. A connector for terminating a plurality of wires to an array of contacts comprising:

a connector body comprising a cylindrical housing having a central axis and a plug-shaped insulator mounted in the housing;

an array of contacts mounted in the plug-shaped insulator, each contact having a first end and and a wire terminating end;

an insulation displacement slot formed on the wire terminating end of each contact, wherein each slot is parallel to said central axis and comprises a flared open end and a closed end;

a wire end from each of the plurality of wires positioned one each adjacent the flared open end of each insulation displacement slot;

an insulating disk orthogonal to said central axis having an array of apertures which mates with the array of contacts; and a back shell which mates to the connector body and pushes against the insulating disk, whereby the backshell advances the insulating disk in a direction which is parallel to said central axis onto the contacts and the insulating disk forces the wires into the insulation displacement slot without the use of auxiliary tools.

8. The connector of claim 7 further comprising:

a threaded coupling between the housing and the backshell, whereby screwing the backshell onto the housing provides a mechanical advantage to advance the insulating disk onto the contact and force the wire ends into the insulation displacement slots.

9. The connector of claim 8 wherein the wire terminating end of each contact is blade shaped and the apertures in the insulating disk which mate with the contacts are rectangular 10. The connector of claim 8 wherein the wire terminating end of each contact is tubular and the apertures in the insulating disk which mate with the contacts are circular.

11. The connector of claim 8 further comprising:

a shoulder formed on the backshell, whereby the insulating disk is advanced onto the contacts by the shoulder and the insulating disk creates a strain relief for the wires.

12. The connector of claim 11 further comprising:

an aperture in the center of the insulating disk for the passage of the plurality of wires.

13. The method of terminating a plurality of wire ends to an array of IDC contacts oriented along the central axis of a cylindrical connector body comprising:

positioning each of the wire ends adjacent an end of the IDC contacts;

positioning an insulating disk orthogonal to said central axis and against the wire ends, the insulating disk having an array of apertures which matches the array of IDC contacts;

positioning a threaded backshell against the insulating disk; and screwing the backshell onto the connector body, whereby the threaded backshell provides a mechanical advantage to advance the insulating disk in a direction which is parallel to said central axis onto the IDC contacts and the insulating disk forces the wire ends into the IDC contacts.

* * * * *